US005687956A

United States Patent [19]

Vesper

[11] Patent Number: 5,687,956

[45] Date of Patent: Nov. 18, 1997

[54] POST-AND-PANEL BUILDING WALLS

[76] Inventor: Dale E. Vesper, 5654 Oceanic Rd., Holiday, Fla. 34690

[21] Appl. No.: 588,138

[22] Filed: Jan. 18, 1996

Related U.S. Application Data

[60] Division of Ser. No. 179,848, Jan. 11, 1994, Pat. No. 5,509,640, which is a continuation-in-part of Ser. No. 835,241, Feb. 12, 1992, Ser. No. 912,895, Jul. 13, 1992, abandoned, and Ser. No. 14,640, Feb. 8, 1993, Pat. No. 5,421,558, said Ser. No. 835,241, is a continuation-in-part of Ser. No. 178,261, Apr. 6, 1988, Pat. No. 5,184,808, and Ser. No. 455,061, Dec. 22, 1989, Pat. No. 5,129,628.

[51] Int. Cl.[6] ..... E04H 17/16

[52] U.S. Cl. ..... 256/31; 256/24; 256/73; 52/309.7; 52/586.1

[58] Field of Search ..... 256/31, 19, 24, 256/73; 405/267; 52/586.1, 586.2, 761, 220.3, 220.2, 290, 781, 169.1–169.4, 238, 239, 309.16, 601, 309.7

[56] References Cited

U.S. PATENT DOCUMENTS

| | | | |
|---|---|---|---|
| 2,039,601 | 5/1936 | London | 52/78 X |
| 2,107,418 | 2/1938 | Keller | 52/586.2 |
| 2,883,852 | 4/1959 | Midby | 52/761 X |
| 3,160,249 | 12/1964 | Pavlecka | 52/586.2 |
| 3,503,165 | 3/1970 | Hardt | 52/220.2 X |
| 5,007,222 | 4/1991 | Raymond | 52/586.1 |
| 5,421,558 | 6/1995 | Vesper | 256/31 |
| 5,509,640 | 4/1996 | Vesper | 256/31 |

*Primary Examiner*—Harry C. Kim
*Attorney, Agent, or Firm*—Charles A. McClure

[57] ABSTRACT

Reinforced fence and building wall construction having upright tubular posts supporting lightweight foam wall panels extending from post to post. The vertical side edges of the panels are recessed to accommodate enough of the post circumferential extent to conceal the posts from exterior view. The panels have reinforcing members, preferably both upper and lower, extending horizontally between and to the panel vertical side edges. Each end of a reinforcing member is similarly recessed and has an adjacent lip, preferably formed from the end of the reinforcing member before its recessing, fitting closely about the post. During installation of such a wall the lips of the reinforcing members are fastened to their respective posts.

7 Claims, 2 Drawing Sheets

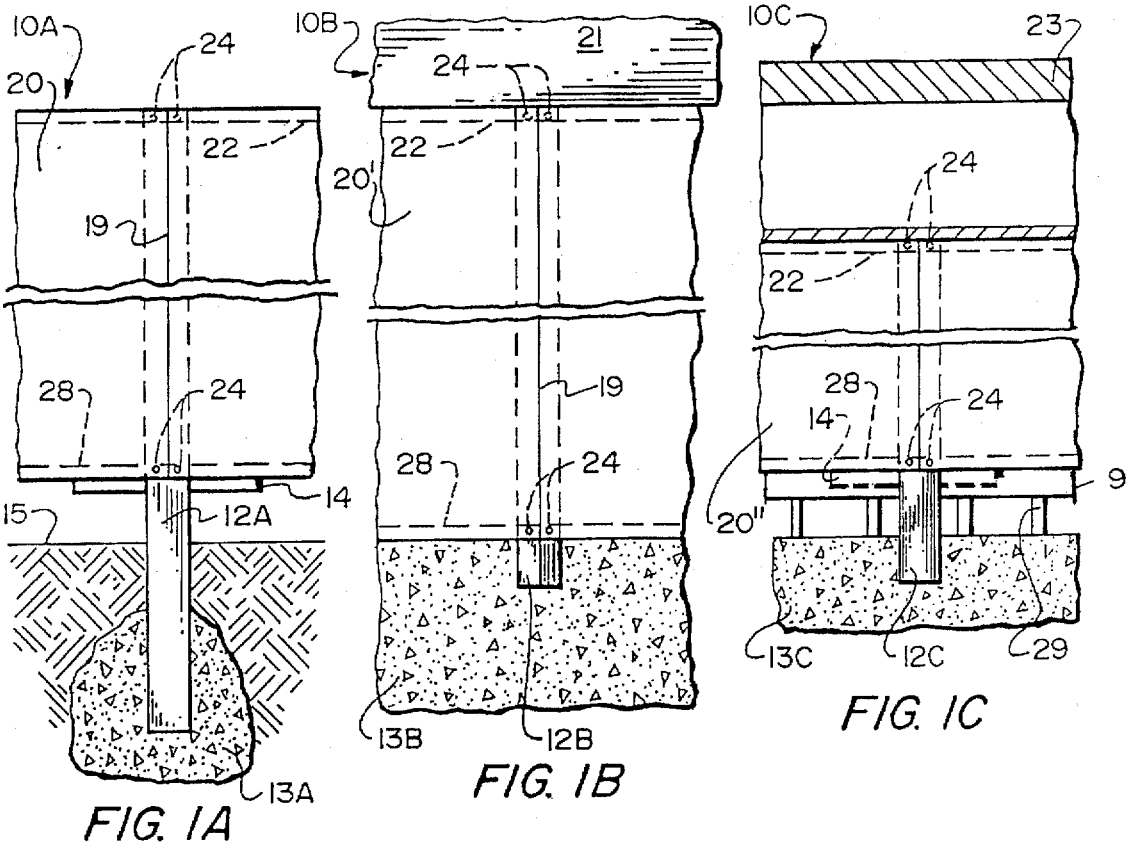
FIG. 1A
FIG. 1B
FIG. 1C
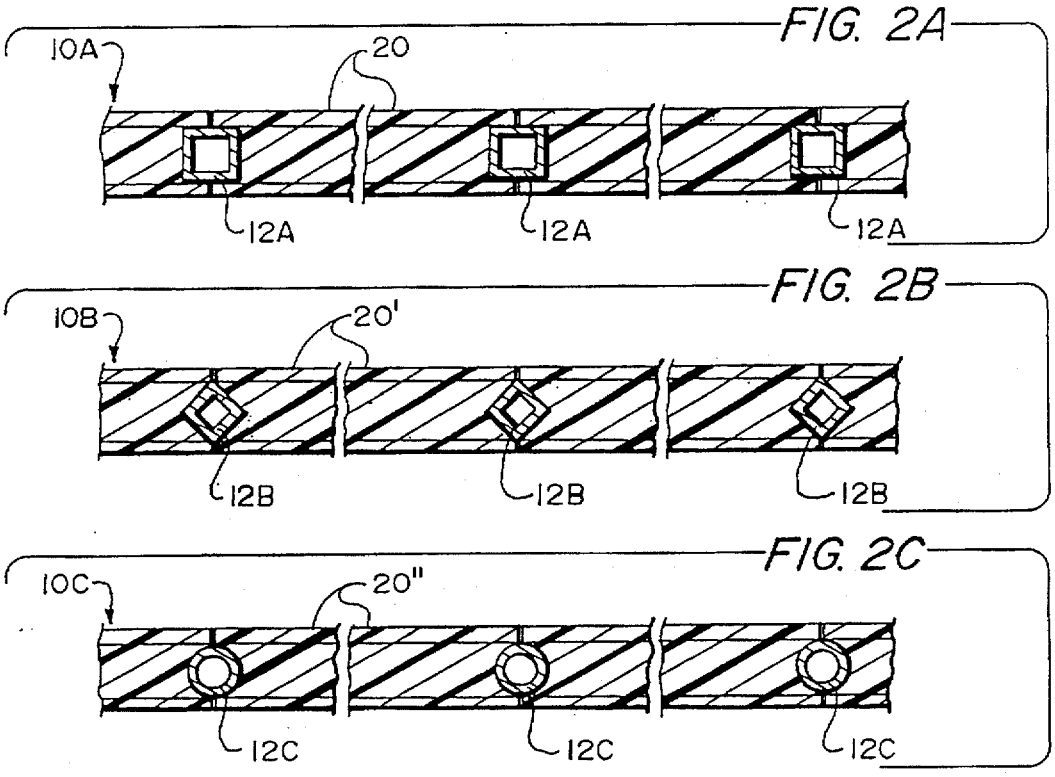
FIG. 2A
FIG. 2B
FIG. 2C

POST-AND-PANEL BUILDING WALLS

This is a divisional application Ser. No. 08/179,848 filed Jan. 11, 1994, now U.S. Pat. No. 5,509,640, which is a continuation-in-part of applications Ser. No. 07/835,241 filed Feb. 12, 1992, still pending, Ser. No. 07/912,895 filed Jul. 13, 1992, now abandoned, and Ser. No. 08/014,640 filed Feb. 8 1993, now U.S. Pat. No. 5,421,558, the first of which is a continuation-in-part of applications Ser. No. 07/178,261 filed Apr. 6, 1988, now U.S. Pat. No. 5,184,808, and Ser. No. 07/455,061 filed Dec. 22, 1989, now U.S. Pat. No. 5,129,628.

TECHNICAL FIELD

This invention relates to post-and-panel fence and building walls with tubular upright posts fitting in hollowed vertical edges of panels preferably reinforced with end-to-end horizontal members.

BACKGROUND OF THE INVENTION

Fence walls of upright posts and reinforced lightweight panels have been disclosed by the present inventor as in the aforementioned patent applications, and have proved their merit in actual use. Contributions by other inventors to this field are identified in those patents, as in their specification or in the references cited during examination and prominently listed on their respective cover sheets.

The present invention discloses the utility of similar but distinct post-and-panel fence walls and building walls, external and/or internal, including load-bearing as well as non-load-bearing walls.

SUMMARY OF THE INVENTION

A primary object of the present invention is to extend proven post-and-panel fence wall technology to other post and panel walls.

Another object of this invention is to adapt post-and-panel construction to exterior and interior building walls.

A further object of the invention is to use tubular posts and lightweight reinforced panels in load-bearing building walls.

Yet another object of this invention is to provide reinforced insulating panels suitable for interior and exterior building walls.

A still further object of the invention is to accomplished the foregoing objects in an economical and simplified manner.

In general, the objects of the present invention are attained by providing in-line post-and-panel structures wherein upright posts support intervening panels by contact vertical edges of the panels.

More particularly, in plan the posts are tubular, and the vertical side edges of adjacent panels are recessed to accommodate the half circumferences of an intervening post. The panels are thicker from face to face than similar transverse dimension of the posts, so that the edge recessing does not erupt to either face of the panels, and abutting vertical edge portions of adjacent panels effectively conceal the intervening post from external view along substantially their entire vertical extent.

The panels advantageously have horizontal reinforcing members either embedded therein or extending along the panel bottom and/or top horizontal edges. The reinforcing members are fastened at their opposite ends to the respective posts flanking a panel therebetween.

The posts are anchored at their bottom ends in subjacent supporting means, such as underground footings. The posts preferably also carry auxiliary supporting means extending horizontally a short distance therefrom to underlie and/or overlie in close alignment with portions of adjacent panel horizontal top and/or bottom edges.

In a preferred embodiment, the panels have reinforcing channel members along the bottom horizontal edge and optionally along the top horizontal edge thereof. Auxiliary supporting means takes the form of a short upturned channel affixed at one end to the post to underlie an end portion of the panel bottom reinforcing channel.

Other objects of the present invention, together with means and methods for attaining the various objects, will become apparent from the following description and the accompanying diagrams of preferred embodiments presented here by way of example rather than limitation.

SUMMARY OF THE DRAWINGS

FIGS. 1A, 1B, and 1C are fragmentary side sectional elevations, partly sectioned away, of a fence wall, exterior building wall, and interior building wall, respectively, according to this invention;

FIGS. 2A, 2B, and 2C are plan views of various post-and-panel junctions suitable, respectively in fence walls, exterior building walls, and interior building walls according to this invention;

FIGS. 4A and 4B are respectively sequential plan views, similar to FIGS. 3A and 3D, of the bottom part of a reinforced panel and its assembly to a square post oriented diagonally instead of edge-on;

DESCRIPTION OF THE INVENTION

Figure 3A:
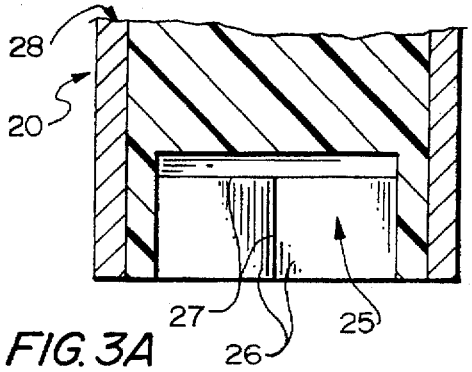
FIGS. 3A, 3B, 3C, and 3D comprise a sectional plan and an end elevation of a bottom end portion of a reinforced panel, and then an elevation and a sectional plan of its assembly to a square post.

FIG. 1A shows, in sectional elevation, fence wall 10A having an upright post 12A whose base portion is secured below ground level 15 in footing 13A (shaded for concrete). Pair of panels 20 abut one another along slit 19 between their adjacent vertical edges. At about ground level, stops 14 affixed to the post underlie and support bottom edge portions of the respective panels. Upper and lower reinforcing members 22 and 28 extend horizontally along the top and bottom edges of each panel and abut one another at the post, to which fasteners 24 secure the ends of the reinforcing members.

FIG. 1B shows, in sectional elevation, exterior building wall 10B, with upright post 12B based in sidewall footing 13B and sandwiched edgewise by pair of panels 20' with upper and lower horizontal reinforcing members 22 and 28 as before, except that there is no gap between the footing and the bottom of the panels and, thus, no stop underlying the lower reinforcing members. Roof 21 overlies and preferably rests on the panel top edges and their upper reinforcing members 22 and preferably ties to the top ends of peripheral posts.

FIG. 1C shows, also in sectional elevation, interior building partition wall 10C, with upright post 12C rising from floor footing 13C and through underfloor airspace provided by joints 29 and flooring 9, upon top of which the bottom edges of pair of panels 20" rest along with their lower reinforcing members 28. Ceiling 23 overlies (well above) the illustrated shoulder-height partition panel top edges and the upper reinforcing members 22 of the panel, with bottom edges and reinforcing members 28 resting on the floor. As before, both reinforcing members are secured by fasteners 24 to post 12C, and stop 14 (dashed lines) may be used at floor level or be superseded by floor support.

FIG. 2A shows wall 10A in fragmentary plan view, partly broken away to conserve space while showing three posts 12A in-line, each spaced between a pair of panels 20 assembled thereto with vertical side edges of adjacent panels abutting one another at both faces of each. The posts are square in tubular cross-section, with two sides of each parallel, and two sides perpendicular, to the panel faces and fitting into complementary notch-like recesses in the abutting vertical panel edges. Such notch-like recess is twice as wide as it is deep, and does not erupt to either panel face so as to receive and conceal half of the peripheral extent of the post from outside.

FIG. 2B shows wall 10B in similar fragmentary plan view, partly broken away. Three posts 12A are in-line spaced between pairs of panels 20' assembled thereto with vertical side edges of adjacent panels abutting one another at both faces of each. The posts are square in tubular cross-section, with one diagonal of each parallel, and the other diagonal perpendicular, to the panel faces and fitting into complementary triangular recesses in the abutting panel edges.

FIG. 2C shows wall 10C similarly. Three posts 12A and four panels 20" are assembled in-line with vertical side edges of adjacent panels abutting one another at both faces of each. The posts are round in tubular cross-section. Semi-cylindrical recesses in the abutting vertical panel edges accommodate the posts, as the other shapes of notches received the diversely oriented square posts.

For consistency in representation, the fence post of FIG. 1A is shown with the square post in one orientation in FIG. 2A, and the exterior building wall utilizes a like post in diagonal orientation in FIG. 2B, and the interior wall of FIG. 1C has a round post in FIG. 2C, it will be understood that different shapes, sizes, and orientations of tubular posts may be used in any of the walls, notwithstanding that structural considerations, personal preference, cost, or availability may determine which wall contains which post.

Succeeding views illustrate how panel vertical side edges and the ends of the horizontal panel-reinforcing members are indented to accommodate a peripheral or circumferential one-half of a particular post/orientation arrangements, and how the reinforcing members are preferably swaged and then are secured to the posts by fasteners 24.

FIG. 3A shows, in sectional plan, a bottom end portion of panel 20, with upturned channel-shaped reinforcing member 28. T-shaped slit 27 in the channel bed bisects the end for slightly more than one half the width of a square post and then extends toward opposite sides slightly more than an equal distance each way, outlining pair of potential tabs 26 that can be turned up as indicated here by a pair of diverging dashed arrows-and further in subsequent views. The foam of the panel is indented as notchlike recess 25 of a size to accommodate one-half of the extent of a square post (in plan).

Figure 3D:
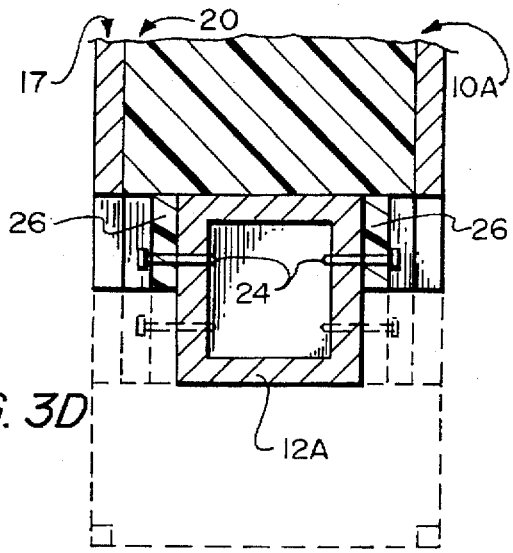
Figure 3B:
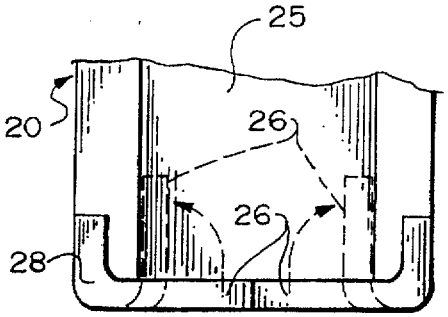

FIG. 3B is a side elevational view corresponding to the plan view of FIG. 3A and showing the lower part of a vertical side edge of panel 20 adapted to accommodate an upright post as shown later. Slit 26 bisects the bed of upturned channel-shaped reinforcing member 28. Dashed arrows indicate how the tabs formed by such slitting can be turned upward at the left and right, respectively, to abut the lowest portions of the sidewalls of recess 25 in the panel edge.

Figure 3C:
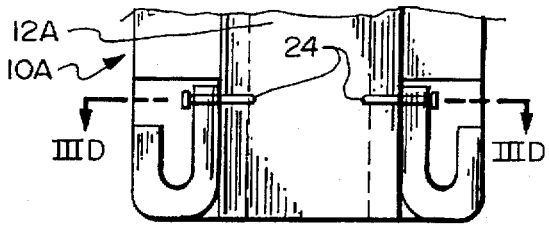

FIG. 3C shows in like elevation the same lower part of panel 20 as in FIG. 3A but with tabs 26 turned upward and with post 12A in place in the former recess with its bottom end between the upturned tabs. Fasteners 24 inserted from the outside through the respective tabs and through the adjacent sidewalls of the post secure the panel to the post, whose inside wall surface is shown in dashed lines.

FIG. 3D shows, in sectional plan taken at IIID—IIID in FIG., 3C, the appearance of panel 20 with post 12A in place between upturned tabs 26 and secured together by fasteners 24 as in fence 10A. Also indicated (dashed lines) in this view is an adjacent like panel as a mirror image of this one to illustrate how a post is sandwiched and concealed from the exterior by a pair of panels with their vertical side edges juxtaposed into abutment with one another.

Figure 4A:
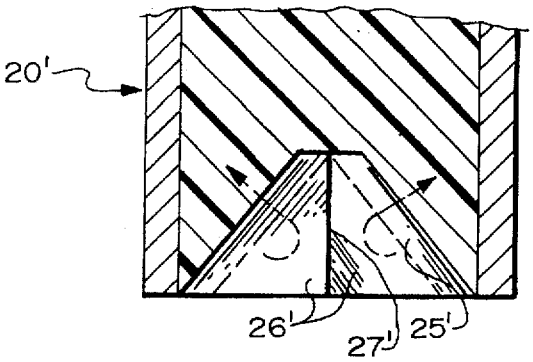
Figure 4B:
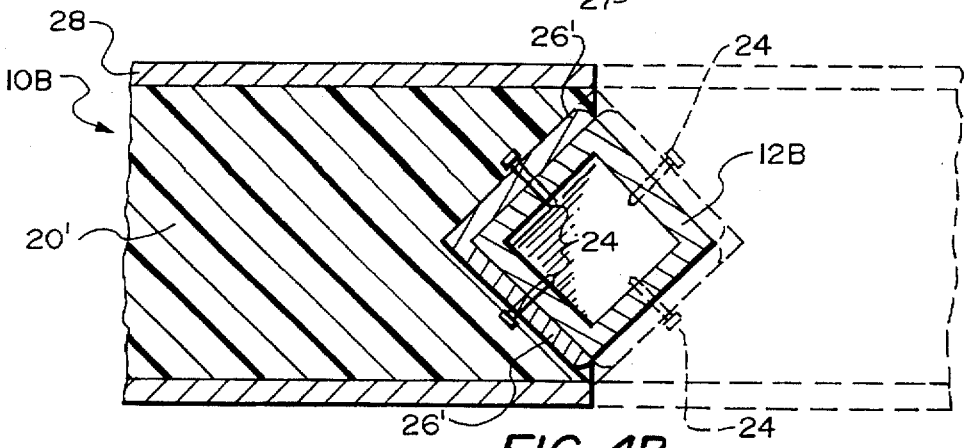

As indicated in FIG. 1B, a square post may be oriented with its diagonals directed as the sides of the edge-on post were in the FIG. 3A-D series of views. Such re-orientation necessitates different recessing and tabbing of the bottom end portion of the panel and its reinforcing member. FIGS. 4A and 4B illustrate such an embodiment, corresponding to FIGS. 3A and FIG. 3D of the previous embodiment.

FIG. 4A shows in plan panel 20' with same upturned reinforcing member 28 but with the panel edge indented by triangular recess 25'. Straight medial slit 27' extends from the outer edge to the apex of the triangular recess, forming two potential tabs 26' adapted to be swung upward as indicated here by a pair of diverging dashed arrows, and shown further in the next view.

FIG. 4B shows in plan, as in fence 10B, panel 20' with tabs 26' upturned against the sidewalls of post 12B, the same as the post in the last sequence of views except for its diagonal orientation here. It is also apparent that FIG. 4B is analogous to FIG. 3C, and the transition is accomplished without any need to show any equivalents of FIGS. 3B–C. Here again the panel is mirrored by a like aligned panel in dashed lines, the two panels together sandwiching the post between them and concealing it from the exterior.

It also will be understood more generally that, if desired, each of the square and round posts may be provided with flanges adapted to extend into slotlike further indentations of the recesses in panel vertical side edges, for greater strength, security, or alignment assurance. Radial single-flange or parallel double-flange additions to the posts can be visualized as analogs of the I-beam post of the present inventor's patented fence walls. Of course, flanges tend to sacrifice the cost advantage of tubular posts.

Preferred embodiments and variants have been suggested for this invention. Other modifications may be made, as by adding, combining, deleting, or subdividing compositions, parts, or steps, while retaining all or some of the advantages and benefits of the present invention-which itself is defined in the following claims.

I claim:

1. Post-and-panel wall structure comprising upright tubular metal posts having a substantially square transverse cross-section and being arranged in-line and spaced a panel length apart and anchored at their bottom ends, and in-line wall panels intervening from post to post and having abutting vertical edges recessed to accommodate half the in-line plan extent of adjacent individual posts as viewed in plan, thereby concealing the posts between the level of the top edge to the level of the bottom edge of the abutting panels as viewed in elevation, wherein the panels include a horizontal reinforcing member extending substantially the entire panel length between vertical side edges thereof and including fastener means securing the ends of the horizontal reinforcing member to the respective adjacent posts, and each end of the horizontal reinforcing member has a lip swaged to conform to the post shape, and the fastening means secures each lip to the respective adjacent post.

2. Wall structure according to claim 1, wherein the panels include both upper and lower such horizontal reinforcing members.

3. Method of constructing a post-and-panel wall, wherein upright tubular posts having cross-sectional dimensions support intervening in-line wall panels of uniform face-to-face thickness along vertical edges of the panels, comprising the steps of providing polymeric foam panels with vertical faces and side edges thicker in face-to-face cross-section than the greatest cross-sectional dimension of the upright posts to be abutted thereby, including adding to each panel a reinforcing member extending the full width of the panel, recessing the vertical side edges of the panels to accommodate substantially one-half of the perimeter of the posts, installing such posts upright in-line along a wall site and spaced center-to-center a single panel width apart, installing such a panel between and supported by each two adjacent posts, with the perimeter of each post accommodated by the recessed vertical side edges of its two adjacent panels and concealed thereby, anchoring the bases of the posts and swaging the ends of the reinforcing members to contact at least one side of each adjacent post, and fastening the side edges of the panels to their respective adjacent posts.

4. Method according to claim 3, including the steps of so adding both an upper panel-reinforcing member and a lower panel-reinforcing member, and so fastening each such member at its opposite ends to the respective adjacent posts.

5. Method according to claim 3, wherein the posts have a substantially square transverse cross-section, and the vertical side edges of the panels are recessed to accommodate a post with its sides oblique to the in-line direction, and including the step of orienting the posts with their corners pointing in the in-line direction before installing a panel between its adjacent posts.

6. Method according to claim 3, including the step of installing the posts and the panels as a self-standing building wall.

7. Method of installing a post-and-panel building wall having in line a plurality of wall panels and a plurality of upright wall-supporting posts, comprising the steps of anchoring at a building wall site a plurality of such posts having substantially square tubular cross-section on centers spaced apart the length of any one panel, with the post faces oriented obliquely to the in-line direction;

providing wall panels having substantially horizontal top and bottom edges from end to end, and having vertical edges at each end indented therealong to receive therewithin substantially one-half in cross-section of the adjacent upright supporting posts; and including in each wall panel at least one reinforcing member extending from end to end of the panel, inserting one such panel between each two adjacent posts for support, and concealing a substantial vertical length of each post within the adjacent panel end indentations, swaging the reinforcing member ends to fit against one or more faces of their respective adjacent posts to aid in securing the panel and post together, and securing the ends of such reinforcing member to the respective adjacent posts.

* * * * *